US009909829B2

(12) United States Patent
Vossler

(10) Patent No.: US 9,909,829 B2
(45) Date of Patent: Mar. 6, 2018

(54) MUZZLE BRAKE

(71) Applicant: PM Research Inc., Wellsville, NY (US)

(72) Inventor: Stephen Paul Vossler, Wellsville, NY (US)

(73) Assignee: PM Research Inc., Wellsville, NY (US)

( * ) Notice: Subject to any disclaimer, the term of this patent is extended or adjusted under 35 U.S.C. 154(b) by 0 days.

(21) Appl. No.: 15/333,054

(22) Filed: Oct. 24, 2016

(65) Prior Publication Data

US 2017/0299316 A1 Oct. 19, 2017

Related U.S. Application Data

(63) Continuation of application No. 14/541,597, filed on Nov. 14, 2014, now Pat. No. 9,593,900.

(60) Provisional application No. 61/906,082, filed on Nov. 19, 2013, provisional application No. 62/028,506, filed on Jul. 24, 2014.

(51) Int. Cl.

| | |
|---|---|
| ***F41A 21/00*** | (2006.01) |
| ***F41A 21/36*** | (2006.01) |
| ***F41A 21/34*** | (2006.01) |

(52) U.S. Cl.

CPC ..... *F41A 21/36* (2013.01); *F41A 21/34* (2013.01)

(58) Field of Classification Search

CPC ..... F41A 21/36; F41A 21/30; F41A 21/34
USPC ..... 89/14.3
See application file for complete search history.

(56) References Cited

U.S. PATENT DOCUMENTS

| | | | | | |
|---|---|---|---|---|---|
| 1,380,171 | A * | 5/1921 | Abbot | F41A 21/28 | 89/1.1 |
| 1,628,896 | A * | 5/1927 | Medearis | F41A 21/02 | 42/76.01 |
| 1,636,357 | A * | 7/1927 | Cutts, Jr. | F41A 21/36 | 89/14.3 |
| 2,101,848 | A * | 12/1937 | Green | F41A 21/34 | 181/223 |
| 2,212,683 | A * | 8/1940 | Hughes | F41A 21/36 | 89/14.3 |
| 2,212,685 | A * | 8/1940 | Hughes | F41A 21/36 | 89/14.3 |
| 2,322,370 | A * | 6/1943 | Lance | F41A 21/36 | 89/14.3 |
| 2,453,121 | A * | 11/1948 | Cutts | F41A 21/36 | 42/79 |
| 2,899,866 | A * | 8/1959 | Clark et al. | F41A 21/32 | 89/127 |
| 4,545,285 | A * | 10/1985 | McLain | F41A 21/36 | 89/14.3 |
| 4,942,801 | A * | 7/1990 | Schuemann | F41A 21/28 | 89/14.3 |
| 5,036,747 | A * | 8/1991 | McClain | F41A 21/36 | 89/14.3 |

(Continued)

*Primary Examiner* — Samir Abdosh
(74) *Attorney, Agent, or Firm* — Bennet K. Langlotz; Langlotz Patent & Trademark Works, Inc.

(57) ABSTRACT

A muzzle device that may be attached to the barrel of a firearm that includes structures which influence the flow characteristics of exhausting propellant gases for suppressing muzzle flash, counter acting the rearward and upward motion of the muzzle during firing, and reducing the concussion directed towards the shooter as well as personnel to the sides of the shooter.

27 Claims, 10 Drawing Sheets

(56) References Cited

U.S. PATENT DOCUMENTS

| | | | | | |
|---|---|---|---|---|---|
| 5,123,328 | A * | 6/1992 | Schuemann | F41A 21/28 | 89/14.3 |
| 5,423,242 | A * | 6/1995 | Schuemann | F41A 21/28 | 89/14.3 |
| 5,675,107 | A * | 10/1997 | Ledys | F41A 21/36 | 89/14.05 |
| 8,061,254 | B2 * | 11/2011 | Heath | F41A 21/34 | 89/14.2 |
| 2013/0227871 | A1 * | 9/2013 | Stone | F41A 21/30 | 42/76.1 |
| 2016/0091269 | A1 * | 3/2016 | Miller, III | F41A 21/36 | 89/14.3 |

* cited by examiner

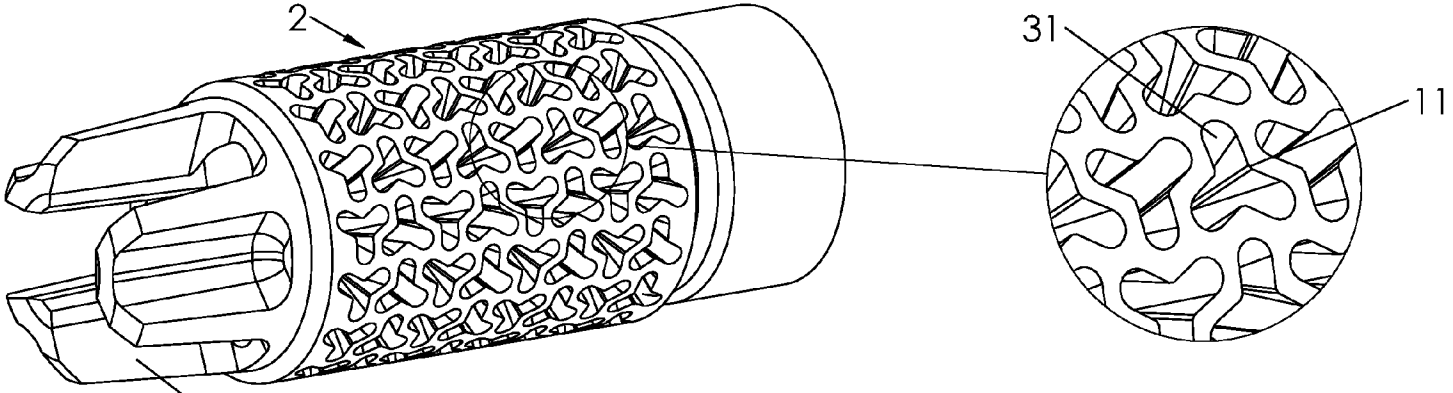
FIG. 1b
FIG. 1a
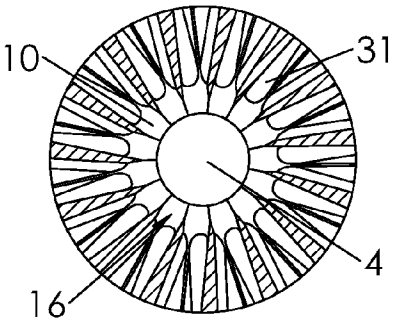
FIG. 1d
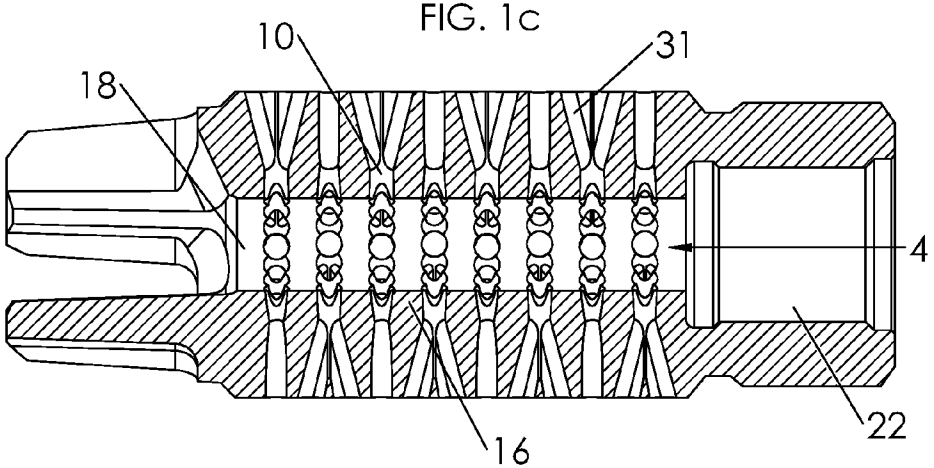
FIG. 1c

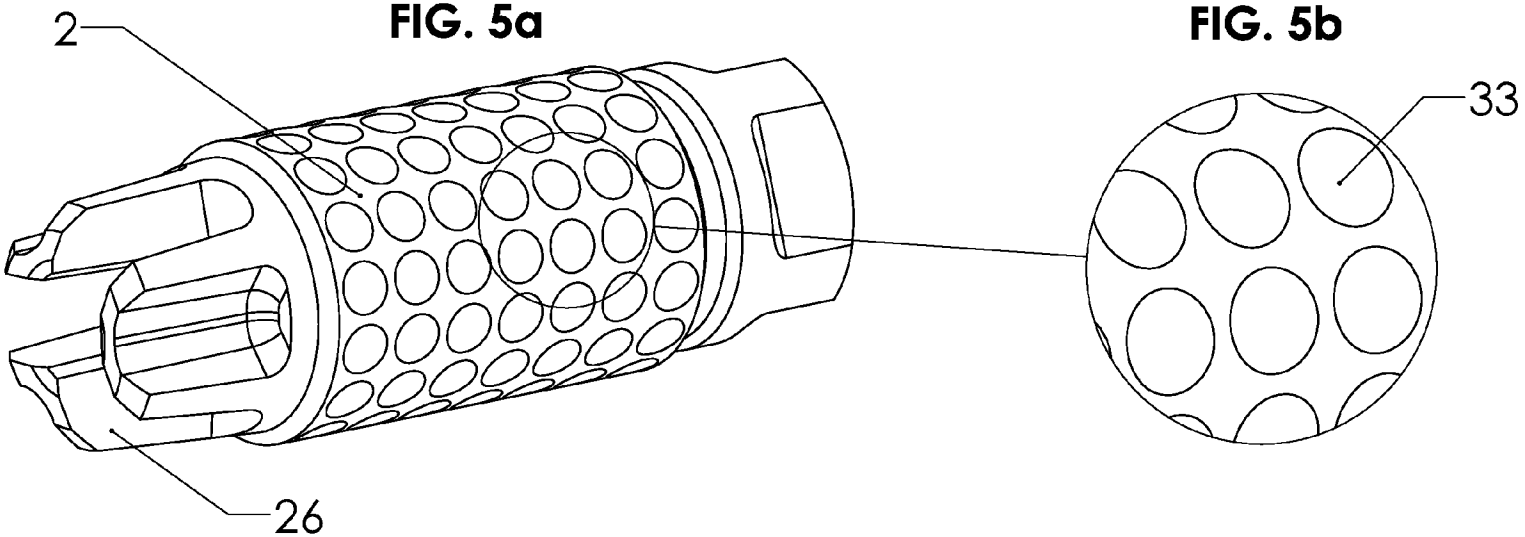
FIG. 5a
FIG. 5b
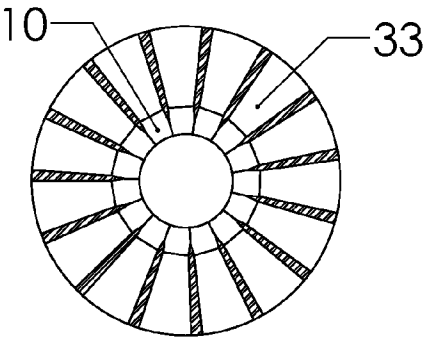
FIG. 5d
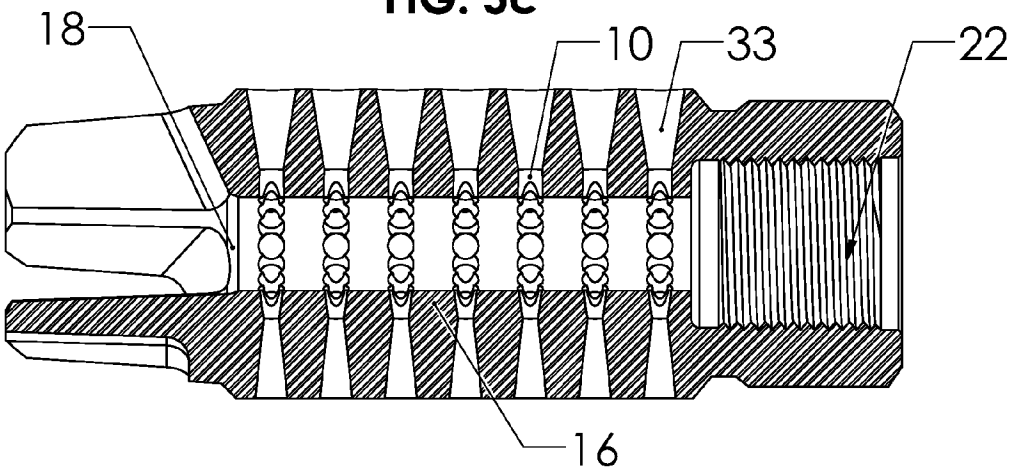
FIG. 5c

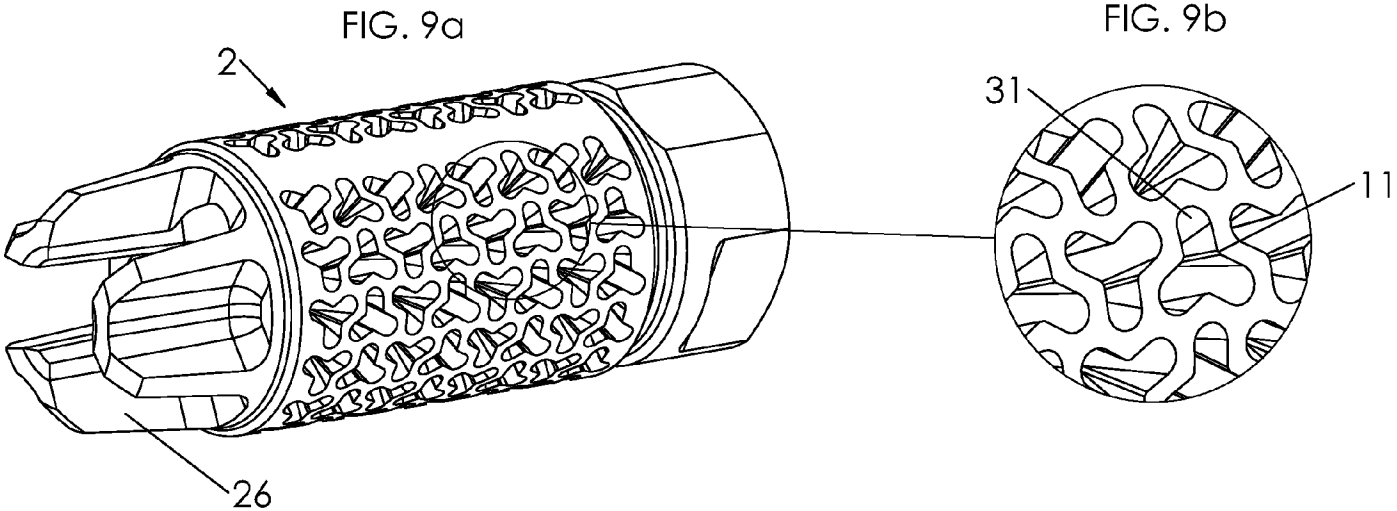
FIG. 9b
FIG. 9a
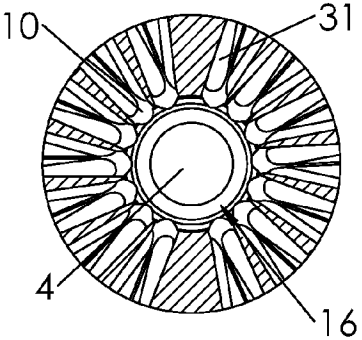
FIG. 9d
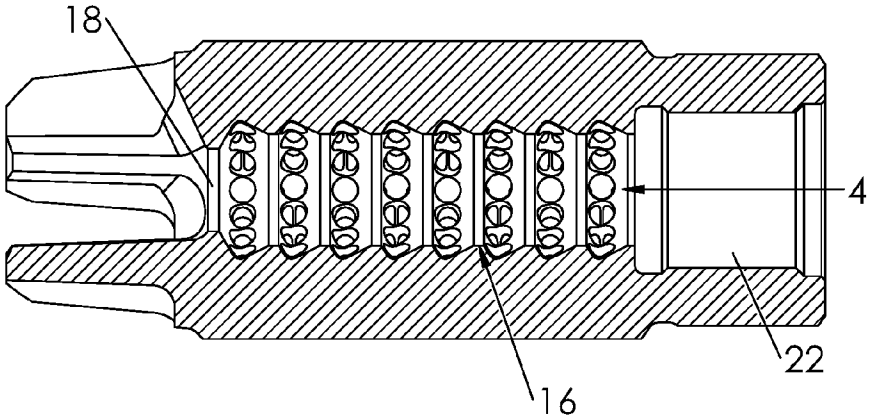
FIG. 9c

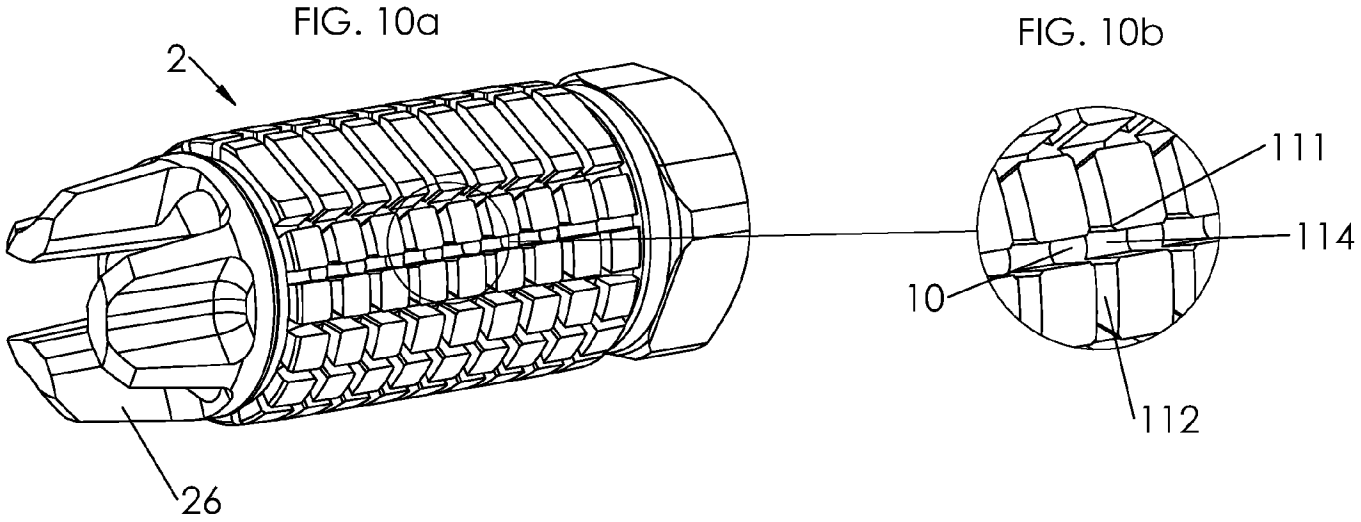
FIG. 10a
FIG. 10b
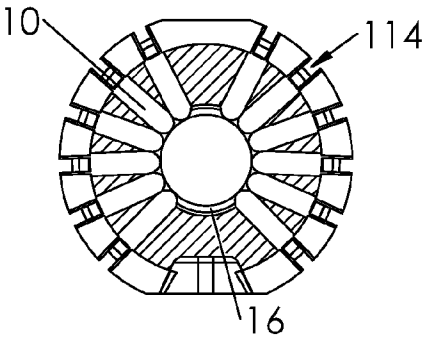
FIG. 10d
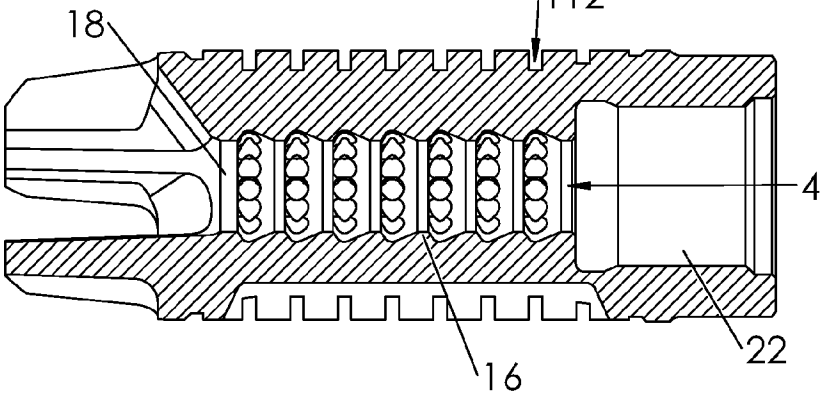
FIG. 10c

MUZZLE BRAKE

CROSS-REFERENCE TO RELATED APPLICATION

This is a Continuation of U.S. patent application Ser. No. 14/541,597, entitled "MUZZLE BRAKE," filed Nov. 14, 2014, which claims the benefit of U.S. Provisional Patent Application No. 61/906,082 filed on Nov. 19, 2013, entitled "MUZZLE DEVICE," and U.S. Provisional Patent Application No. 62/028,506 filed on Jul. 24, 2014, entitled "MUZZLE BRAKE, which are hereby incorporated by reference in their entirety for all that is taught and disclosed therein.

BACKGROUND OF THE INVENTION

Field of the Invention

The present invention generally relates to firearms and, more particularly, to a muzzle device that reduces the recoil, muzzle flash, and side concussion of a firearm allowing for better muzzle control, improved situational awareness of the shooter, and reduced visual signature to better conceal the shooter from enemy return fire.

Description of Related Art

Many muzzle brakes, compensators, and flash hiders have been developed over the years that either suppress muzzle flash or reduce and redirect recoil. Many of these devices do an acceptable job of achieving one of these tasks, but none are able to achieve both tasks equally well. Furthermore, in recent years there has been an increasing number of so called "multipurpose" muzzle devices introduced to the market that claim to increase muzzle control through recoil reduction and redirection, as well as reduce muzzle flash and excessive side concussion. Most of these devices employ a small expansion chamber or passageway, and a multitude of small vent holes passing though the side of the device in order to redirect as well as regulate both the pressure and the flow rate of the exhausting propellant gases. However, since none of these devices employ an effective method of expanding and cooling the escaping gases, or disrupting shock wave formation, they are only able to provide a slight improvement in flash suppression over conventional muzzle breaks and compensators. In view of these problems associated with known firearms and known muzzle devices, there is a need for an improved muzzle device that can effectively and substantially reduce recoil and muzzle flash.

SUMMARY OF THE INVENTION

It is an objective of the present invention to redirect, expand, cool, and disrupt shock wave formation of the exhausting propellant gases to achieve a reduction as well as a redirection of recoil while concurrently suppressing muzzle flash.

According to one object of the present invention, a muzzle device for a firearm is provided comprising: a generally cylindrical body adapted for attachment to the muzzle of a firearm barrel and having an exterior; wherein the generally cylindrical body includes a coaxial passageway for removable communication with a muzzle; wherein the generally cylindrical body has at least one radial vent hole in communication with the coaxial passageway; wherein the generally cylindrical body includes a coaxial exit hole in communication with the coaxial passageway; wherein the exterior of the generally cylindrical body includes at least one slot, wherein each of the at least one slots are in communication with one of the at least one radial vent holes.

According to another object of the present invention, a muzzle device for a firearm is provided, the device comprising: a generally cylindrical body adapted for attachment to the muzzle of a firearm barrel; wherein the generally cylindrical body includes a coaxial passageway in front of and communicating with the muzzle; wherein the generally cylindrical body includes a coaxial exit hole in front of and communicating with the coaxial passageway; wherein the coaxial passageway and the exit hole are sufficiently large to allow the passage of the fired bullet; wherein the coaxial passageway includes at least ten radial vent holes that pass through a side of the generally cylindrical body communicating between the coaxial passageway and the outside atmosphere; wherein an exterior of the generally cylindrical body includes at least one slot in communication with and radiating away from one of the at least ten radial vent holes and wherein each of the at least one slots exit the side of the body.

According to yet another object of the present invention, a muzzle device for a firearm is provided, the device comprising: a generally cylindrical body adapted for attachment to the muzzle of a firearm barrel and having an exterior; wherein the generally cylindrical body includes a coaxial passageway in front of and communicating with the muzzle; wherein the generally cylindrical body includes a coaxial exit hole in front of and communicating with the coaxial passageway; wherein the coaxial passageway and the exit hole are sufficiently large to allow the passage of a fired bullet; wherein the coaxial passageway includes at least ten vent holes in the side of the generally cylindrical body between the coaxial passageway and the outside atmosphere; wherein the exterior of the generally cylindrical body includes at least three slots that communicate with, and radiate out from, one of the at least ten vent holes.

It is another objective of the present invention to redirect expand, cool, and disrupt shock wave formation of the exhausting propellant gasses to reduce side concussion to a level less than that of convention muzzle breaks and compensators.

BRIEF DESCRIPTION OF THE DRAWINGS

FIG. 1*a*-1*d* and FIG. 2 show a preferred embodiment of the invention. FIG. 1*a* is a left side isometric view of the muzzle device showing the external features.

FIG. 1*b* is a cropped view of FIG. 1*a* at an enlarged scale detailing the patterns of slots that communicate with and diverge away from the radial vent holes as they pass through the exterior of the device.

FIG. 1*c* is a left side cross section view of the muzzle device showing its internal features, particularly the coaxial passageway, which includes the annular baffles that are formed at the outer edge of the coaxial passageway by the intersections of radial vent holes in each annular pattern. The diverging slots are illustrated originating in each radial vent hole a short distance from the coaxial passageway and diverging away at an angle before passing through the exterior of the device.

FIG. 1*d* is a cross section view of the muzzle device showing the radial holes converging and intersecting each other as they approach the coaxial passageway.

FIG. 2 is a cropped view at an enlarged scale to better illustrate the geometric relationship between the radial venting holes and the diverging slot pattern on the exterior of the device.

FIG. 3*a* is a left side isometric view of the muzzle device showing the external features.

FIG. 3*b* is a cropped view of FIG. 3*a* at an enlarged scale detailing the pattern of oblong slots that are about the same width as the radial vent holes passing through the exterior of the device.

FIG. 3*c* is a left side cross section view of the muzzle device showing its internal features, particularly the coaxial passageway, which includes the annular baffles, and the radial vent holes. The diverging slot is illustrated originating in each radial vent hole a short distance from the coaxial passageway and diverging rearward at an angle before passing through the exterior of the device.

FIG. 3*d* is a cross section view of the muzzle device showing the radial holes converging and intersecting each other as they approach the coaxial passageway.

FIG. 4 is a cropped view at an enlarged scale to better illustrate the geometric relationship between the radial venting holes and the rearward diverging slot pattern on the exterior of the device.

FIG. 5*a*-5*d* and FIG. 6 show another embodiment of the invention where the expansion of gas is accomplished using divergent conical nozzles instead of diverging slots.

FIG. 5*a* is a left side isometric view of the muzzle device showing the external features.

FIG. 5*b* is a cropped view of FIG. 5*a* at an enlarged scale detailing the matrix of milled diverging cones, each starting shortly after the radial holes diverge from the coaxial passageway.

FIG. 5*c* is a left side cross section view of the muzzle device showing its internal features, particularly the coaxial passageway, which includes the annular baffles, the radial vent holes, and the diverging conical nozzles.

FIG. 5*d* is a cross section view of the muzzle device showing the radial holes intersecting at the coaxial passageway, and also the diverging cones that expand the gases from the radial holes.

FIGS. 9*a*, 9*b*, 9*c* and 9*d* depict aspects of the present invention.

FIGS. 10*a*, 10*b*, 10*c* and 10*d* depict aspects of the present invention.

DETAILED DESCRIPTION OF THE PREFERRED EMBODIMENT

Figure 2:
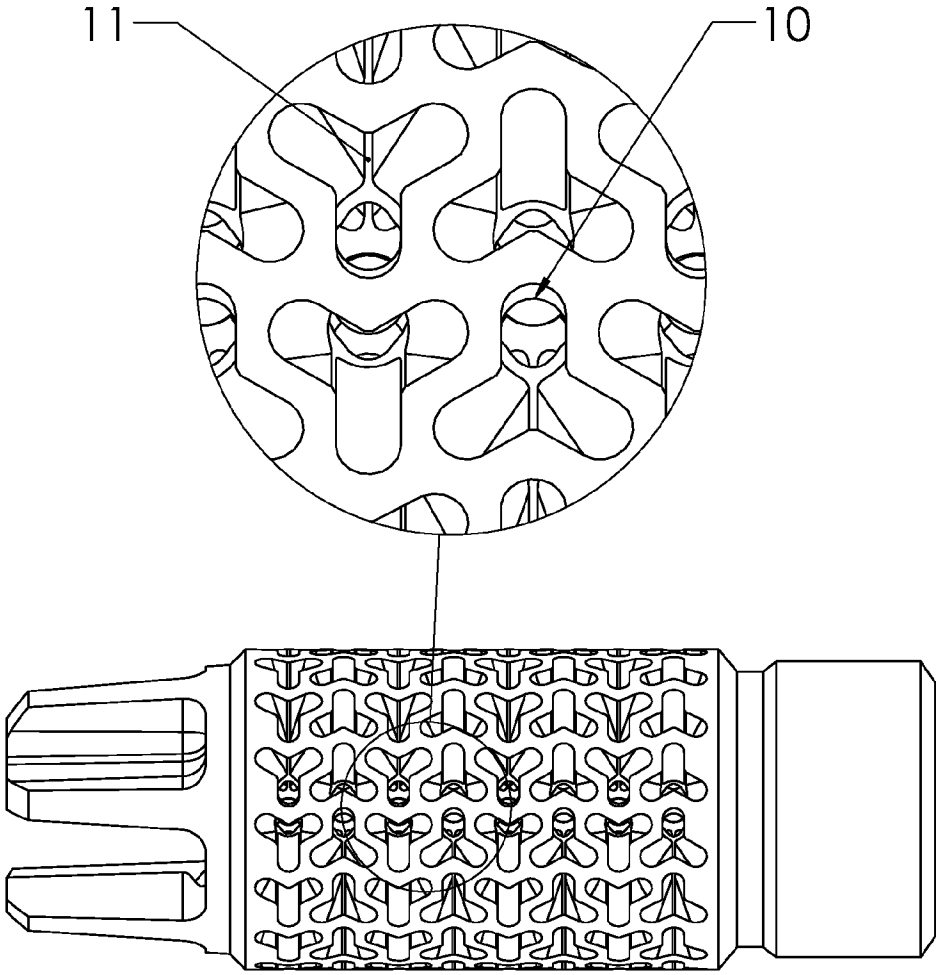

While this invention may be embodied in many different forms, as illustrated in FIGS. 1*a*-1*d*, FIG. 2, FIGS. 3*a*-3*d*, FIG. 4, and FIGS. 5*a*-5*d*. A preferred embodiment is shown in FIGS. 1*a*-1*d*, FIG. 2. This embodiment has a cylindrical body (2) having a coaxial passageway (4) preferably between 1.1 and 1.5 bullet calibers in diameter and preferably between 5 and 7 bullet calibers in length, forward of and communicating with a coaxial threaded bore (22) for attaching the muzzle device to the threaded muzzle of a firearm barrel. The coaxial passageway (4) communicates with the longitudinal front slots (26) through the coaxial exit hole (18), which is preferably the same diameter or smaller than the coaxial passageway (4). The coaxial passageway and the coaxial exit hole are sufficiently large to allow the passage of a fired bullet. When the firearm is fired, the bullet exits the muzzle of the gun and travels along the coaxial passageway (4) of the attached muzzle device and exits through the coaxial exit hole (18), at the front end of the muzzle device.

The coaxial passageway (4) extends along the longitudinal axis of the muzzle device and includes a series of preferably between 6 and 10 closely spaced coaxial annular baffles (16) created by the annular patterns of radial vent holes as they converge and intersect toward the coaxial passageway (4). These annular baffles (16) divert propellant gases away from the path of the bullet into the respective circular array of radial vent holes (10) form which they are formed. These radial venting holes (10) channel propellant gases through the cylindrical body (2) of the muzzle device in a direction that is approximately orthogonal to the longitudinal axis of the muzzle device. The radial vent holes (10) are preferably about ⅓ calibers in diameter with preferably 10 to 18 holes in each circular array.

Figure 3B:
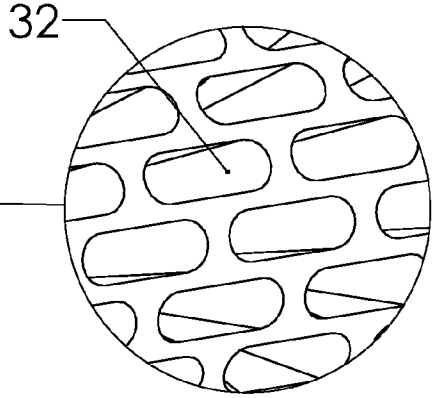
FIG. 3*a*-3*d* and FIG. 4 show another preferred embodiment of the invention where there is only one slot diverging from each radial vent hole.
Figure 3A:
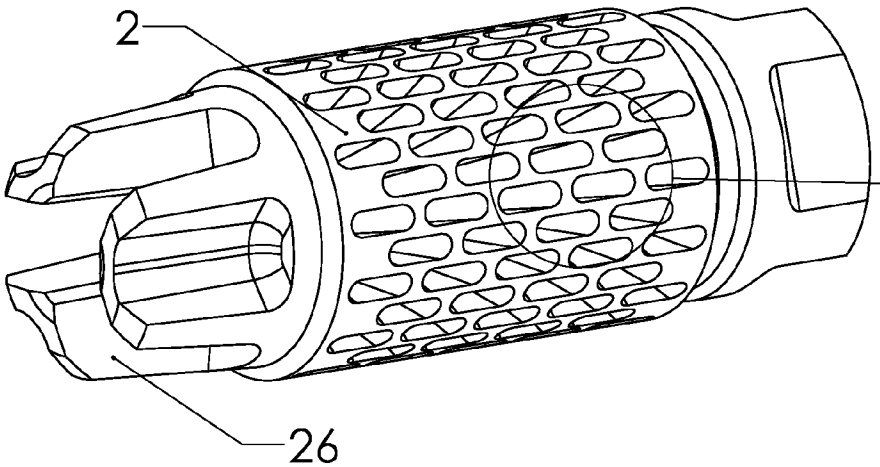
Figure 3D:
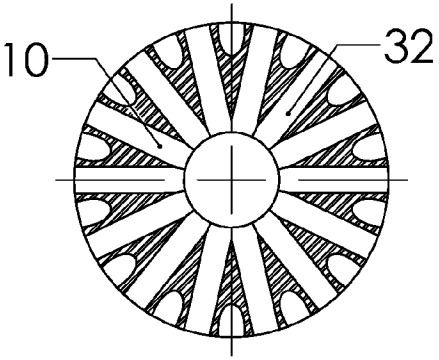
Figure 3C:
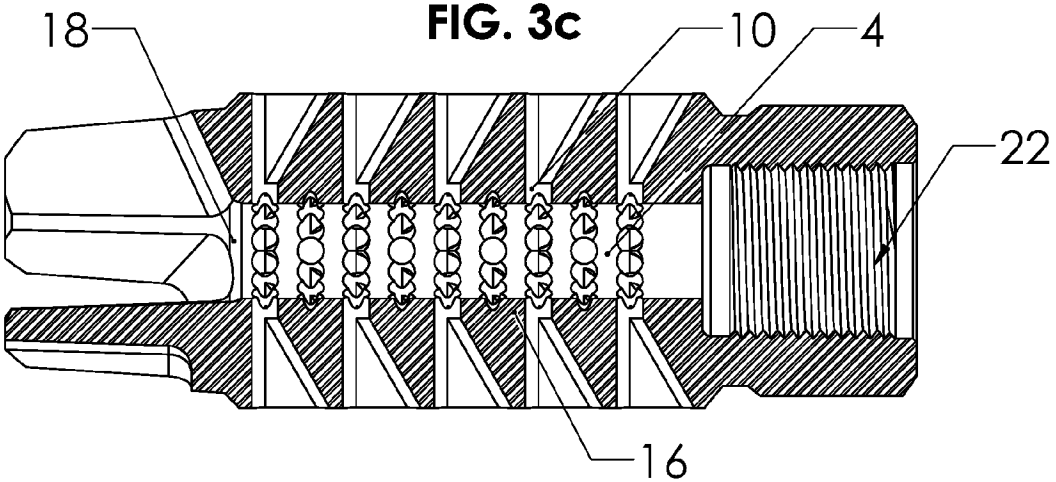
Figure 4:
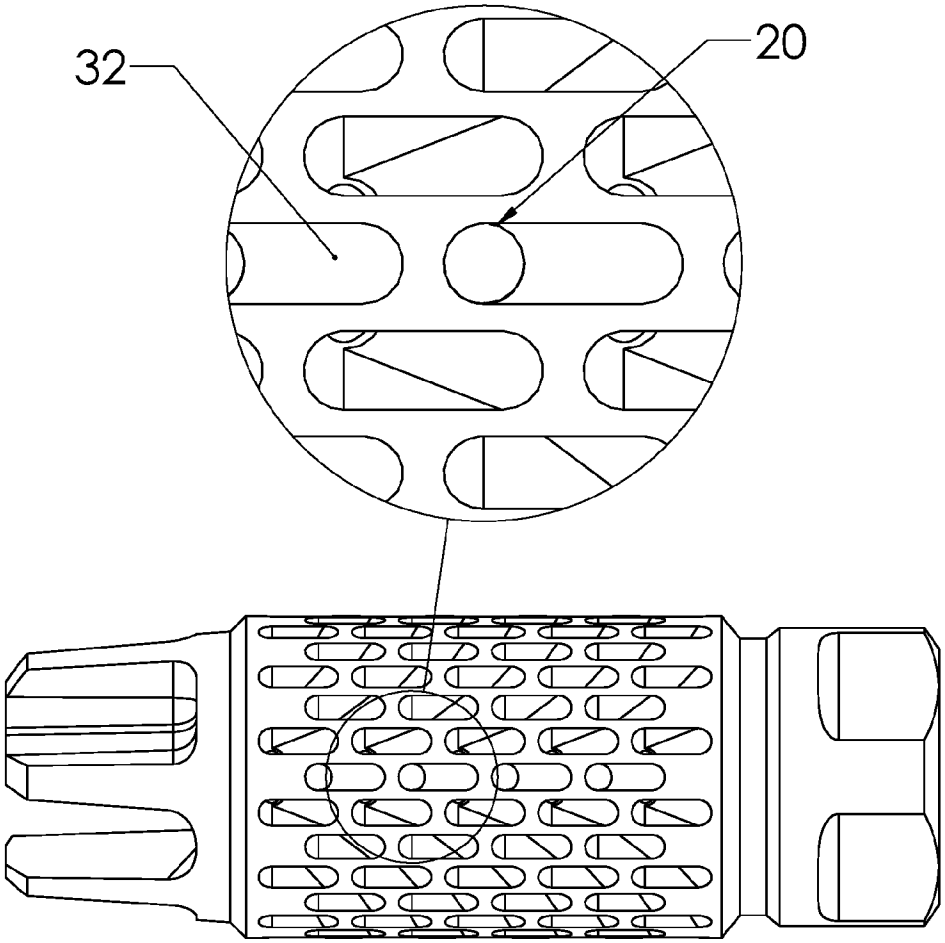

The exterior of the cylindrical body (2) is the portion on the outside of the cylindrical body (2) that is seen in FIG. 1*a*. According to one embodiment, on the exterior of cylindrical body (2) of the muzzle device there is a pattern of three equally spaced diverging slots (31) located at and communicating with each radial vent hole (10). These patterns effectively increase the cross-sectional area of the radial vent holes (10) as the radius of the cylindrical body (2) increases. These slots (31) diverge in a radial direction away from the axis of the radial vent holes at an angle of approximately 15 degrees. When measured along the exterior surface of the cylindrical body (2) the slots (31) radiate away from the cylindrical wall of the respective radial vent hole from which they originate at (10) to a distance that is approximately equal to their respective maximum width. According to one embodiment, each slot (31) is of sufficient width with respect to the radial vent hole that it radiates from that there are three convex corners (11) formed at the circular wall of the respective vent hole (10). Each of the least one slots have a sufficient depth to effectively expand, cool, and disrupt shock wave formation of exhausting propellant gases. FIGS. 1*a* and 1*b* depict the slots (31) as three convex corners (11) at the exterior. A set of three slots may be drilled and milled to form a "Y" shape. This is the embodiment in which each of the at least one slots is further comprised of three slots (or sub-slots) and each of the three slots (or sub-slots) have convex corners at the exterior. This may also be described as a "Y" shape and there would be many "Y" shaped slots as depicted in FIG. 1*a*. For example, FIG. 1*a* depicts approximately one hundred and twenty slots each made up of three slots (or sub-slots). According to other embodiments, by way of example, you may have one slot with two convex corners to form the shape of "I." There may be two slots with two convex corners to form a "V," there may be three slots with three convex corners that form the shape of "Y," or there may be four slots with four convex corners that form the shape of "X." There may also be 2 slots in the shape of "V" that have 1 convex corner at the bottom, there may be three slots in the shape of a "Y" which have 3 convex corners, there may be four slots in the shape of an "X" which have four convex corners, and so on and so forth. It is important to note that the convex corners may be where two slots intersect or may portions of a single slot. For example, FIGS. 3*a*, 3*b* and 4 depict the embodiment where each of the at least one slots (32) are oblong shaped at the exterior. The oblong shaped slot may be said to have convex corners at either end of a single slot. FIGS. 5*a* and 5*b* depict the embodiment wherein each of the at least one slots (33) are circular shaped at the exterior. FIGS. 1*c*, 3*c*, and 5*c* depict each of the at least one slots gradually increasing in diameter from the radial vent hole to the exterior.

When the firearm is fired, high pressure gases travel through the coaxial passageway (4) where it impinges on the annular baffles (16) diverting it away from the bore axis though the radial vent holes (10) into each pattern of diverging slots (31), where due to increased cross section and surface area, the gases are expanded and cooled before escaping to atmosphere. It is also believed that the three convex corners (11), act in a similar manner as prongs on modern high efficiency open prong flash hiders, by disrupting shock wave formation, which is a necessary process in the generation of muzzles flash. If the matrix of diverging slots (31) is of a sufficient relative depth, the propellant gases will be cooled and the shock formation reduced to a sufficient level that the unburned gas components will be less susceptible to ignite upon entering the oxygen rich outside atmosphere, and secondary flash will be suppressed. For effective flash suppression the diverging slots (31) should begin soon after the radial vent holes (10) cease to intersect one another near the coaxial passageway (4). Another important feature of this invention is that the coaxial passageway (4) is only slightly larger than bullet diameter which effectively reduces the internal volume of the device and therefore minimizes the amount of oxygen available to mix with hot propellant gasses in the interior of the device during the firing cycle. This greatly reduces this component of muzzle flash and in particular the first round flash which is due to this phenomenon.

There may be, according to one embodiment, three longitudinal front slots (26) at the front of the muzzle device that communicate with the coaxial passageway (4) though the coaxial exit hole (18). The longitudinal front slots (26) disrupts shock wave formation while expanding and cooling the unburned propellant gases escaping through the coaxial exit hole (18) into the oxygen rich outside atmosphere, and in doing so prevent ignition and flash at the front of the muzzle device.

A muzzle device for a firearm comprising: a generally cylindrical body (2) adapted for attachment to the muzzle of a firearm barrel and having an exterior; wherein the generally cylindrical body (2) includes a coaxial passageway (4) for removable communication with a muzzle, the coaxial passageway (4) having a coaxial exit hole (18); wherein the generally cylindrical body (2) has at least one radial vent hole (10) in communication with the coaxial passageway (4); wherein the exterior of the generally cylindrical body (2) includes at least one slots (e.g. 31, 32, 33), wherein each of the at least one slots is in communication with one of the at least one radial vent holes. There may be at least one coaxial annular baffle (16) created by the annular patterns of radial vent holes (10) as they converge and intersect toward the coaxial passageway (4). FIGS. 1*c*, 3*c* and 5*c* depict that each of the at least one slots (e.g. 31, 32, 33) gradually increase in diameter from the radial vent hole (10) to the exterior.

According to one embodiment a muzzle device for a firearm is provided, the device comprising: a generally cylindrical body (2) adapted for attachment to the muzzle of a firearm barrel; wherein the generally cylindrical body (2) includes a coaxial passageway (4) in front of and communicating with the muzzle; wherein the generally cylindrical body (4) includes a coaxial exit hole (18) in front of and communicating with the coaxial passageway (4); wherein the coaxial passageway (4) and the exit hole (18) are sufficiently large to allow the passage of the fired bullet; wherein the coaxial passageway (4) includes at least one radial vent hole (10) that passes through a side of the generally cylindrical body (2) between the coaxial passageway (4) and the outside atmosphere; wherein an exterior of the generally cylindrical body (2) includes at least one slot (e.g. 31, 32, 33) in communication with and radiating away from one of the radial vent holes (10) and exiting the side (or exterior) of the generally cylindrical body (2). Each of the at least one slots (e.g. 31, 32, 33) radiates from one of the at least one radial vent holes (10). The coaxial passageway (4) may be less than 1.5 times the bullet diameter. According to one embodiment, there may be at least ten radial vent holes. As depicted in FIGS. 1*c*, 3*c* and 5*c*, the coaxial passageway (4) may include several circular arrays of radial vent holes patterned in a linear direction along the axis of the coaxial passageway between the coaxial passageway and the outside atmosphere. The coaxial passageway (4) may also include a series of spaced coaxial annular baffles (16) formed by the convergence of radial vent holes (10) before they reach the coaxial passageway (4), wherein the spaced coaxial annular baffles (16) divert propellant gases away from the path of the bullet into the radial vent holes (10). The coaxial annular baffles (16) may be shaped to divert propellant gases away from the path of the bullet into the radial vent holes (10). They may be for example, chamfered. The effective cross-section at the point where the slot intersects the exterior of the generally cylindrical body (2) may be between 1.1 and 2 times the minimum full cylindrical diameter of the radial vent hole (10). According to one embodiment, the cross-section may increase at a rate equal to that of a geometric cone starting at the minimum full cylindrical diameter and diverging with an included angle of not more than 50 degrees. According to another embodiment, the cross-sectional area may increase at an approximately linear rate as a function of distance from the axis of the coaxial passageway.

Figure 8A:
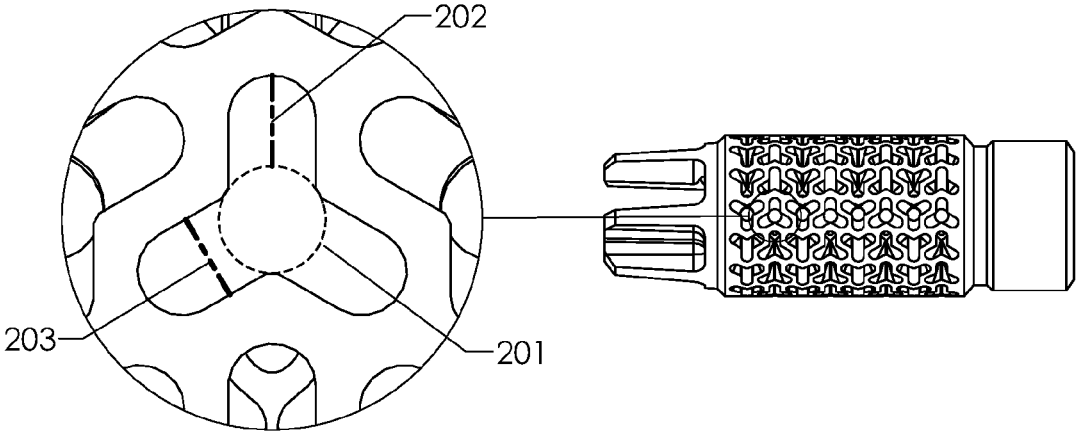
FIG. 8*a* depicts the virtual cylindrical wall of the radial vent hole along the exterior surface of the cylindrical body and the maximum width of the slot.
Figure 8B:
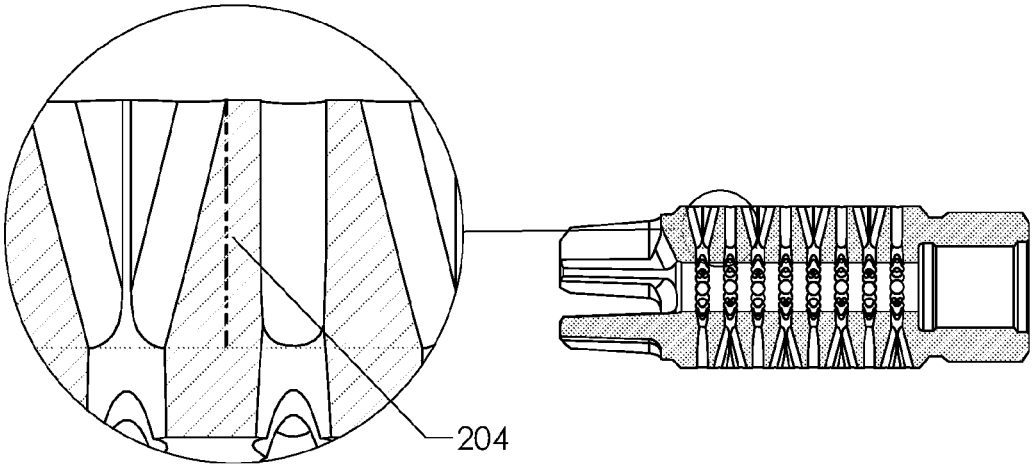
FIG. 8*b* depicts the depth (204) measured from the exterior of the cylindrical body.

With reference to FIGS. 8*a* and 8*b*, the shortest distance measured from the virtual cylindrical wall (201) of the radial vent hole along the exterior surface of the cylindrical body (2) to the farthest point (202) that the slot (31) radiates outward may be greater than half of the maximum width (203) of the slot. The depth (204) measured from the exterior of the body may be greater than the maximum width (203) of the slot.

Figure 6A:
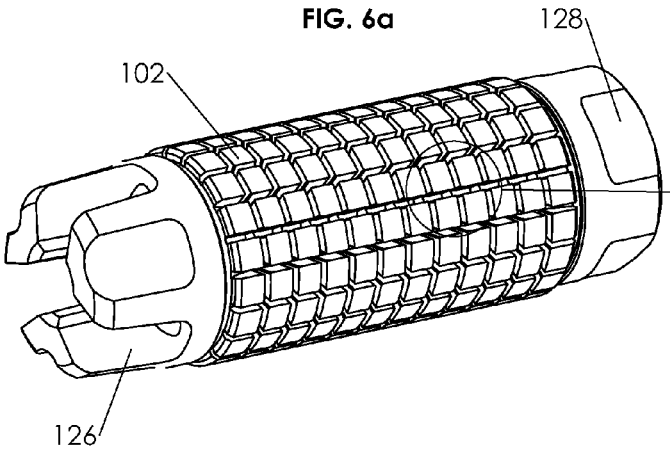
FIG. 6*a* is a left side isometric view of the muzzle device showing the external features.
Figure 6B:
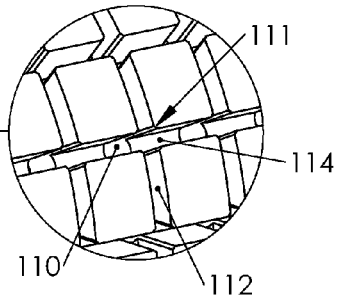
FIG. 6*b* is a cropped view of FIG. 6*a* at an enlarged scale detailing the matrix of axial and circumferential slots that intersect at the center axis of the radial vent holes to create nodes.
Figure 6C:
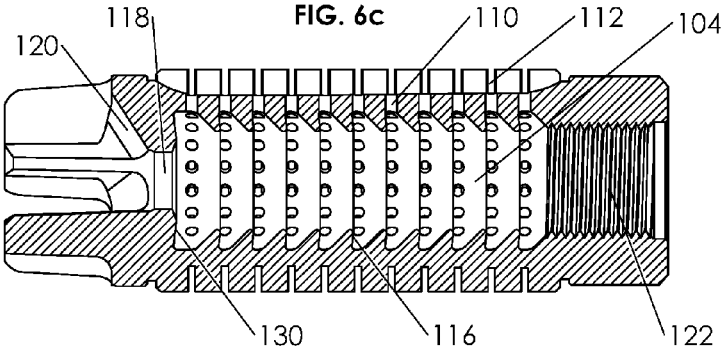
FIG. 6*c* is a left side cross section view of the muzzle device showing the internal features of the muzzle brake, particularly the axial passageway, which includes the coaxial annular baffles, and the radial vent holes.
Figure 6D:
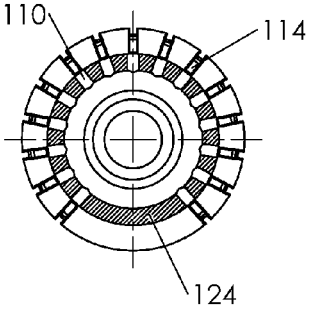
FIG. 6*d* is a cross section view of the muzzle device looking from the back side showing the radial vent holes as well as the non-venting bottom section.
Figure 7:
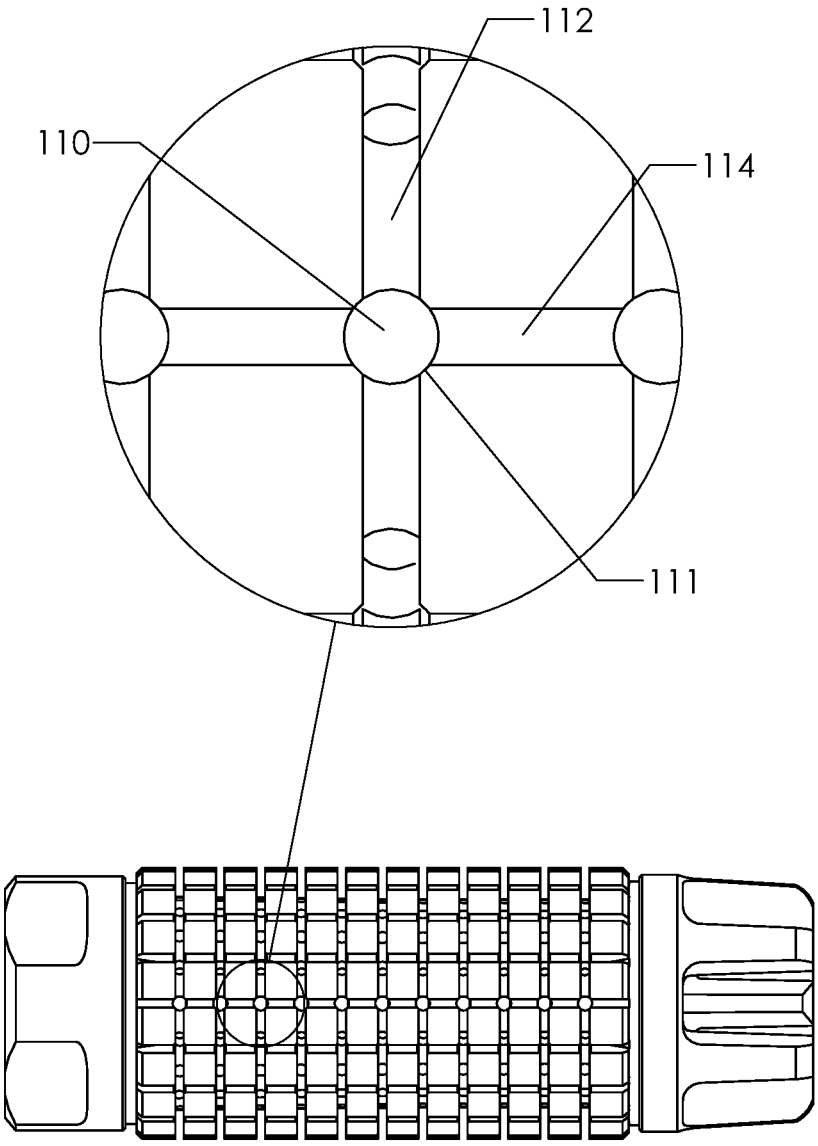
FIG. 7 is a cropped view at an enlarged scale to better illustrate the relative size as well as the geometric relationship between the radial venting holes and the axial and circumferential slots that intersect at the center axis of the radial vent holes to create nodes.

While this invention may be embodied in many different forms, there is illustrated in FIGS. 61*a*-6*d* and FIG. 7 a preferred embodiment comprising a cylindrical body (102) having a coaxial passageway (104) preferably less than 2.5 bullet calibers in diameter and preferably between 5 and 8 bullet calibers in length, forward of and communicating with a coaxial threaded bore (122) for attaching the muzzle device to the threaded muzzle of a firearm barrel. The coaxial passageway (104) communicates with the longitudinal front slots (126) through the coaxial exit hole (118), which is preferably smaller than the coaxial passageway (104), but sufficiently large to permit passage of a fired bullet. When the firearm is fired, the bullet exits the muzzle of the gun and travels along the coaxial passageway (104) of the attached muzzle device and exits through the coaxial exit hole (118) at front end of the muzzle device.

The coaxial passageway (104) extends along the longitudinal axis of the muzzle device and includes a series of preferably between 5 and 15 closely spaced coaxial annular baffles (116) that divert propellant gases away from the path of the bullet into a single circular array of radial vent holes (110) at the root of each annular baffle (116). The series of coaxial annular baffles may divert propellant gases away from the path of the bullet into the vent holes. These radial venting holes (110) channel propellant gases through the cylindrical body (102) of the muzzle device with a velocity vector that is preferably orthogonal to the longitudinal axis of the muzzle device. The radial vent holes (110) are preferably between 0.045 and 0.065 inches in diameter with preferably between 10 and 20 holes in each circular array. The vent holes may have a cross-sectional area small enough to impede the shock wave propagation and flow of exhausting propellant gases through the side of the generally cylindrical body to a level sufficient to reduce the concussion imposed on personnel to the side and rear vicinity of the device; wherein the cross-sectional area may be less than the fraction of one divided by two hundred and fifty (1/250) of a square inch.

The circular arrays of radial vent holes (110) may be arranged in such a way that the bottom of the muzzle device is closed (124) to prevent the vectoring of propellant gases downward, effectively reducing ground disturbance while at the same time creating a reaction force that pushes the muzzle downward to counteract muzzle climb.

On the exterior cylindrical body (102) of the muzzle device adjacent to the axial passageway (104) there is a series of axial slots (114) and circumferential slots (112). These slots are positioned in such a way that they intersect at the points where the radial vent holes (110) exit the cylindrical body (102) of the muzzle brake forming nodes (111). A preferred embodiment is shown in FIG. 7 in which the axial slots (114) and circumferential slots (112) are of sufficient width that the four corners at each node (111) formed by the intersection of the two slots, either slightly touch or come close to touching the walls of the radial vent holes (110).

When the firearm is fired, high pressure propellant gases are channeled through the radial vent holes (110) into each node (111) of the matrix of axial slots (114) and circumferential slots (112), where due to the increased cross-section and increased surface area, the gases are expanded and cooled before being released to the atmosphere. It is also believed that the four corners of each node (111) function in a similar manner as the prongs do on modern high efficiency open prong flash hiders, by disrupting shock wave formation, which is known to be a necessary process in the generation of muzzle flash. If the matrix of axial slots (114) and circumferential slots (112) are of a sufficient relative depth the propellant gasses will be cooled and the shock formation reduced to a sufficient level that the unburned gas components will be less susceptible to ignite upon entering the oxygen rich outside atmosphere, and secondary flash will be suppressed. For effective flash suppression, the depth of both the axial slots (114) and circumferential slots (112) may range from as little as one time the width of the slot, to as much as five times the width of the slots. The slots are of a sufficient relative depth necessary to effectively expand, cool, and disrupt shock wave formation of exhausting propellant gasses. The depth measured from the exterior surface of the body may be greater than the maximum width of the slot.

There may be, according to one embodiment, three longitudinal front slots (126) at the front of the muzzle device that communicate with the axial passageway (104) through the coaxial exit hole (118). The longitudinal front slots (126) disrupt shock wave formation while expanding and cooling the unburned propellant gases escaping through the coaxial exit hole (118) into the oxygen rich outside atmosphere, and in doing so prevent ignition and flash at the front of the muzzle device.

FIGS. 9*a*, 9*b*, 9*c* and 9*d* depict another embodiment with a 1.5 caliber diameter coaxial passageway (4) with an exit hole (18) that is sufficiently large to pass a fired bullet. The coaxial annular baffles (16) may further be chamfered or shaped in a way to more efficiently divert propellant gases away from the path of the bullet into the radial vent holes. The top and bottom of brake are closed in this embodiment to direct more gas out the sides of the brake and reduce ground disturbance.

FIGS. 10*a*, 10*b*, 10*c* and 10*d* depict another embodiment. In this embodiment, there are shaped coaxial annular baffles (16). Also, each vent hole (10) communicates with four slots (112 and 114).

I claim:

1. A muzzle device for a firearm comprising:

an elongated cylindrical body adapted for attachment to the muzzle of a firearm barrel;

the body defining a bore registered with the barrel and having a bore surface;

the body having an exterior surface;

wherein the body defines an array of radial vent holes each extending from the bore surface to the exterior surface;

each vent hole having a vent hole length defined by the radial distance from the bore surface to the exterior surface;

each of the vent holes having a width less than half the vent hole length, and wherein the majority of the vent hole length is tapered;

the array of vent holes including a plurality of rings of vent holes, each ring of vent holes encompassing the body; and the rings being arranged along the length of the body.

2. The muzzle device as in claim 1, wherein each of the vent holes is further comprised of three slots that form a "Y" shape.

3. The muzzle device of claim 1 wherein the vent hole length is greater than the radius of the bore and each vent hole has a cross section at the exterior surface having at least one intersecting slot.

4. The muzzle device of claim 1 wherein the vent hole length is greater than the radius of the bore and the vent hole width is less than 0.1 inch diameter.

5. The muzzle device of claim 1 wherein each vent hole has a cross section at the exterior surface having a plurality of intersecting slots each having a limited slot width less than the width of the vent hole at the exterior surface.

6. The muzzle device of claim 1 wherein each vent hole has a selected width at the bore surface measured in an orientation parallel to the bore, and where the bore has a circumference less than the sum of the selected widths of the vent holes of a ring of vent holes, such that each vent hole intersects with adjacent vent holes prior to intersecting the bore surface.

7. A muzzle device for a firearm having a barrel defining a bore axis, the muzzle device comprising:

a body;

an attachment facility operable to connect the device to the barrel;

the body defining a device bore having a device bore axis registered with the barrel bore axis when the device is connected to the barrel;

the body having a sidewall encompassing the bore and having an external sidewall surface facing away from the device bore axis;

a plurality of elongated passages extending from the bore to the external sidewall surface; and the passages each having first passage portions extending perpendicularly to the device bore axis; and the passages each having second passage portions that are tapered over their entire length, the tapered second passage portions being the majority of the length of the passages.

8. The muzzle device of claim 7 wherein each passage is tapered over at least a majority of its length.

9. The muzzle device of claim 7 wherein each passage has a tapered portion having a length greater than the radius of the device bore.

10. The muzzle device of claim 7 wherein each passage has an articulated cross section over at least a portion of its length, the articulated cross section having a greatest width at the external sidewall surface.

11. The muzzle device of claim 8 including an array of passages distributed about a circumference of the device, and along the length of the device.

12. The muzzle device of claim 8 including a plurality of rings of passages, the rings distributed along the length of the body, each ring comprising a plurality of passages arranged about the body.

13. The muzzle device of claim 7 wherein the body has an elongated cylindrical form, the external sidewall surface has a cylindrical shape centered on the device bore axis, and the sidewall has a radial thickness dimension between the bore and the external sidewall surface greater than the radius of the device bore.

14. The muzzle device of claim 13 wherein the sidewall has a radial thickness dimension between the bore and the external sidewall surface greater than the diameter of the device bore.

15. The muzzle device of claim 8 wherein the passages are less than 0.1 inch diameter.

16. The muzzle device of claim 7 wherein each passage has an articulated cross section over at least a portion of its length, the articulated cross section including concave and convex portions.

17. The muzzle device of claim 8 including at least 10 passages.

18. A muzzle device for a firearm having a barrel defining a bore axis, the muzzle device comprising:

a body;

an attachment facility operable to connect the device to the barrel;

the body defining a device bore having a device bore axis registered with the barrel bore axis when the device is connected to the barrel;

the body having a sidewall encompassing the bore and having an external sidewall surface facing away from the device bore axis;

wherein the body has an elongated cylindrical form, the external sidewall surface has a cylindrical shape centered on the device bore axis, and the sidewall has a radial thickness dimension between the bore and the external sidewall surface greater than the radius of the device bore;

a plurality of elongated tapered passages extending from the bore to the external sidewall surface; and an array of passages having a plurality of passages distributed about a circumference of the device, and a plurality of passages distributed along the length of the device.

19. The muzzle device of claim 18 wherein each passage is tapered over at least a portion of its length, the tapered section having a greatest width at the external sidewall surface and an included angle not more than 50 degrees.

20. The muzzle device of claim 18 wherein each passage is tapered over at least a majority of its length, the tapered section having a greatest width at the external sidewall surface and an included angle not more than 40 degrees.

21. The muzzle device of claim 18 wherein each passage has an articulated cross section over at least a portion of its length, the articulated cross section having a greatest width at the external sidewall surface.

22. The muzzle device of claim 19 wherein each passage has a width at the external sidewall surface, and a length greater than the width.

23. The muzzle device of claim 19 including a plurality of rings of passages, the rings distributed along the length of the body, each ring comprising a plurality of passages arranged about the body.

24. The muzzle device of claim 18 wherein the sidewall has a radial thickness dimension between the bore and the external sidewall surface greater than the diameter of the device bore.

25. The muzzle device of claim 18 wherein the passages are less than 0.1 inch diameter and each passage is tapered over at least a majority of its length.

26. The muzzle device of claim 18 wherein each passage has an articulated cross section over at least a portion of its length, the articulated cross section including concave and convex portions.

27. The muzzle device of claim 18 including at least 10 passages wherein each passage is tapered over at least a majority of its length.

* * * * *